US009144312B2

(12) United States Patent
Grace

(10) Patent No.: US 9,144,312 B2
(45) Date of Patent: Sep. 29, 2015

(54) PORTABLE, COLLAPSIBLE STOOL WITH A SWIVEL SEAT

(71) Applicant: Daniel R. Grace, Old Saybrook, CT (US)

(72) Inventor: Daniel R. Grace, Old Saybrook, CT (US)

(73) Assignee: GCI Outdoor, Inc., Higganum, CT (US)

( * ) Notice: Subject to any disclaimer, the term of this patent is extended or adjusted under 35 U.S.C. 154(b) by 55 days.

(21) Appl. No.: 13/735,605

(22) Filed: Jan. 7, 2013

(65) Prior Publication Data

US 2013/0187431 A1 Jul. 25, 2013

Related U.S. Application Data

(60) Provisional application No. 61/583,810, filed on Jan. 6, 2012.

(51) Int. Cl.
*A47C 4/00* (2006.01)
*A47C 9/10* (2006.01)

(52) U.S. Cl.
CPC .. *A47C 4/00* (2013.01); *A47C 9/105* (2013.01)

(58) Field of Classification Search
CPC ..... A47C 4/00
USPC ..... 297/16.2, 45, 42, 344.21, 344.26, 297/440.15, 461
See application file for complete search history.

(56) References Cited

U.S. PATENT DOCUMENTS

| | | | | |
|---|---|---|---|---|
| 340,754 | A * | 4/1886 | Bartelle | 280/43.15 |
| 615,476 | A | 12/1898 | Chapman | |
| 1,921,984 | A | 8/1933 | Moore | |
| 1,961,241 | A * | 6/1934 | McKenney | 108/99 |
| 1,969,313 | A | 8/1934 | Meeker | |
| 2,197,343 | A | 4/1940 | Marx | |
| D259,306 | S | 5/1981 | Licastro, II | |
| 4,544,203 | A | 10/1985 | Younger et al. | |
| D282,320 | S | 1/1986 | Anderson | |
| 4,934,638 | A | 6/1990 | Davis | |
| 5,063,701 | A | 11/1991 | Ottens | |
| 5,709,428 | A | 1/1998 | Hugghins | |
| 5,752,537 | A | 5/1998 | Kranzler | |
| 5,851,052 | A | 12/1998 | Gustafsson | |
| 6,634,704 | B1 | 10/2003 | Bergquist | |
| 6,749,265 | B1 * | 6/2004 | Wang | 297/440.1 |
| 6,871,905 | B2 * | 3/2005 | Grace | 297/16.2 |
| 6,896,330 | B1 * | 5/2005 | Yu | 297/344.21 |
| 7,032,965 | B2 * | 4/2006 | Howell et al. | 297/16.1 |
| 7,722,123 | B2 * | 5/2010 | Holland | 297/440.1 |
| D660,024 | S * | 5/2012 | Castle | D6/335 |
| 2008/0093909 | A1 * | 4/2008 | Deng | 297/440.15 |

* cited by examiner

*Primary Examiner* — David R Dunn
*Assistant Examiner* — Jody Giacoman
(74) *Attorney, Agent, or Firm* — McCormick, Paulding & Huber, LLP

(57) ABSTRACT

A portable collapsible stool has at least three legs including separable upper and lower parts releasably formed together by telescopic joint connections and biased into connected engagement by elastomeric cords. Each of the legs is connected to another of the legs intermediate for mutual pivotal movement between a collapsed condition wherein the legs are disposed in generally parallel relation to each other and a set-up condition wherein the legs are spread apart at the upper and lower ends thereof and cross each other intermediate the ends. A seat member with a pivotal upper portion mounted on the upper ends of the legs is disposed in a seating position when the stool is in its set-up condition, and a panel assembly connected to the legs proximate the lower ends thereof provides lateral, anti-splay reinforcement for the legs to increase the carrying capacity of the stool.

20 Claims, 7 Drawing Sheets

PORTABLE, COLLAPSIBLE STOOL WITH A SWIVEL SEAT

CROSS-REFERENCE TO RELATED APPLICATION

This application claims the benefit of U.S. Provisional Application No. 61/583,810, filed Jan. 6, 2012, which is incorporated herein by reference.

FIELD OF THE INVENTION

The present invention relates generally to stools and seats, and more particularly to stools and seats of portable, collapsible type.

BACKGROUND OF THE INVENTION

Lightweight, portable, collapsible stools and seats of a type with which the present invention is concerned are enjoying increasing popularity for use in viewing sports activities, fireworks displays, air shows and in a wide variety of other outdoor activities such as camping, hunting, fishing and the like. However, such stools and seats as heretofore made available provide somewhat limited load carrying capacity and may not offer the degree of stability and security desired by a person of larger stature. Further, in some outdoor activities where lightweight portable seating may be desired, as for example, woodland activities, such as camping, hunting and fishing, less than ideal ground support conditions are often encountered. Thus, for example, where sandy or soft ground conditions are encountered, the lower ends of the legs or "feet" of a stool or seat may penetrate the ground making it difficult to attain adequate ground support to provide a comfortable and stable seating position.

Additionally, many collapsible stools and seats use a flexible web of fabric as a seating panel that is taut when the stool or seat is in a set-up condition, but which flexes and collapse as the stool or seat is collapsed. While being adequate as a seating panel, such flexible seats may be uncomfortable for some users. Further, in use, the flexible seat may sag with the user's weight, which makes it difficult for a user to pivot on the seat or reposition oneself.

In view of the foregoing, there is a need for a portable and collapsible stool or seat having at least three legs with increased load carrying capacity as compared to conventional seats and stools of generally similar design. It is a further aim of the present invention to provide an improved stool or seat of the foredescribed general type that provide increased ground support to enable stable comfortable seating on soft or sandy ground. It is a further aim of the present invention to provide an improved stool or seat with a seat member providing comfort to a seated user while permitting easy adjustment, and preferably simple pivoting on the stool without disrupting its position and stability. In conjunction with the aforesaid objectives, it is an aim of the present invention to provide an improved stool or seat that may be rapidly and easily collapsed to a portable condition or deployed in a set-up condition.

SUMMARY OF THE INVENTION

In accordance with an embodiment of the present invention, a collapsible stool or seat comprises at least three axially elongated legs having upper and lower ends and connected together intermediate their ends for mutual pivotal movement between a folded condition wherein the legs are disposed in generally adjacent axially parallel relation to each other and a set-up condition wherein the legs are disposed in crossing relation to each other and the leg upper and lower ends, respectively, define geometrically shaped seating and supporting planes.

In a preferred embodiment of the collapsible stool or seat in accordance with the present invention, a seat member is mounted on the leg upper ends when the legs are in the setup position. More preferably, the seat member comprises a swivel seat having a lower portion adapted for connection to the leg upper ends and an upper portion adapted for pivoting rotation relative to the lower portion. More preferably, the seat member has 360 degree of pivotal freedom wherein movement of the seat member does not affect or disrupt the set-up condition of the stool or the stability thereof.

In alternate embodiments of the collapsible stool or seat in accordance with the present invention, the legs are connected to each other proximate the lower ends thereof by at least one flexible panel assembly or a plurality of linking members, which may be constructed and arranged to be disposed in tension between adjacent legs and in a plane generally parallel to the supporting plane when the stool is set up and in use to provide lateral, anti-splaying reinforcement for the legs and thereby increase the load carrying capacity of the stool. The panel assembly or linking members may be further arranged for ground engagement to increase the area of stool ground support so that the stool may be used on soft or sandy ground, which may be penetrated by the supporting legs.

These and other objects, features and advantages of the present invention will become apparent in light of the detailed description of embodiments thereof, as illustrated in the accompanying drawings.

DETAILED DESCRIPTION OF PREFERRED EMBODIMENTS

Figure 1:
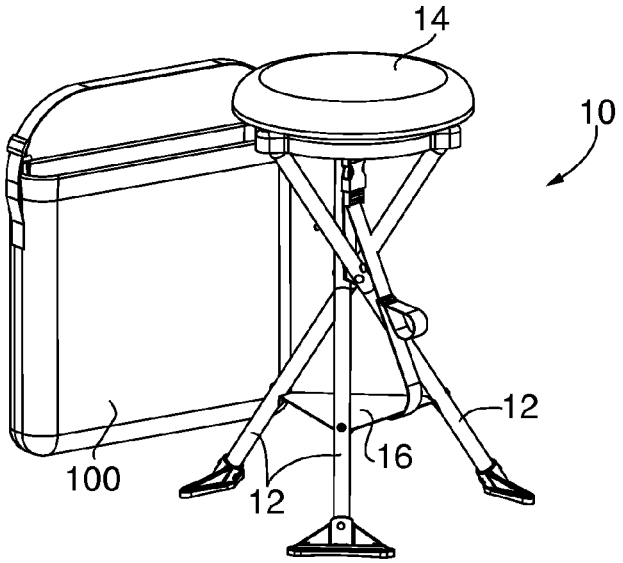
FIG. 1 is a perspective view of a portable collapsible stool in accordance with a first embodiment of the present invention shown in a setup condition.

Turning now to the drawings, a portable collapsible stool or seat embodying the present invention is shown in FIG. 1 and designated generally by the reference numeral 10. The illustrated stool 10 essentially comprises at least three axially elongated legs, indicated generally at 12, supported for limited mutual pivotal movement between a set-up condition and a folded or collapsed condition. The stool 10 further includes a seat member, indicated generally at 14, mounted on the upper ends of the legs 12 and maintained in a substantially horizontal seating position by the legs 12 when the stool 10 is in its set-up condition resting on a generally horizontal supporting surface, as illustrated in FIG. 1. Further in accordance with the present invention, a panel assembly, indicated generally at 16, is connected to and extends between lower end portions of the legs 12.

Figure 4:
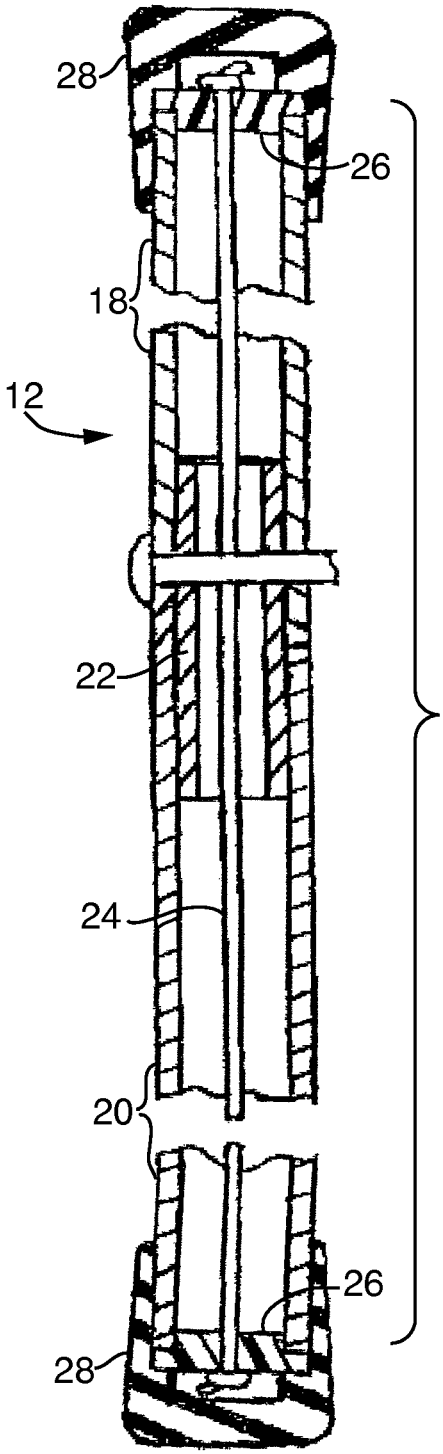
FIG. 4 is a somewhat enlarged fragmentary axial cross-sectional view of a collapsible leg assembly used in the stool of FIG. 1 shown in its set-up condition.

Considering now the illustrated stool 10 in further detail in accordance with presently preferred embodiments, the legs 12 generally comprise tubular leg assemblies that are collapsible to a bundled condition. A typical collapsible leg assembly 12, as shown in FIG. 4, includes a tubular upper part 18 and a tubular lower part 20 releasably connected in coaxial alignment with each other by a connecting sleeve 22 of reduced diameter slidably received and mounted in fixed position within the lower end of the upper part 18. The sleeve 22 projects for some distance from the lower end of the leg upper part 18 and is adapted to be releasably slidably received within the upper end of a leg lower part 20. An elastomeric cord 24 (e.g., a bungee cord), generally coaxially supported within the tubular leg assembly formed by the telescopic joiner of the upper and lower parts 18 and 20 biases or urges the two leg parts toward each other and maintains the leg parts in connected assembly. As illustrated, the upper and lower ends of the elastomeric cord 24 pass through central apertures in washers 26 sized to seat upon the upper and lower ends of the cylindrically tubular members 18 and 20, respectively. Knots in the upper and lower ends of the cord 24 engage the washers 26 and maintain the cord 24 in tension, whereby the upper and lower leg parts 18 and 20 are urged toward each other and maintained in connected assembly, as hereinbefore discussed.

Figure 3:
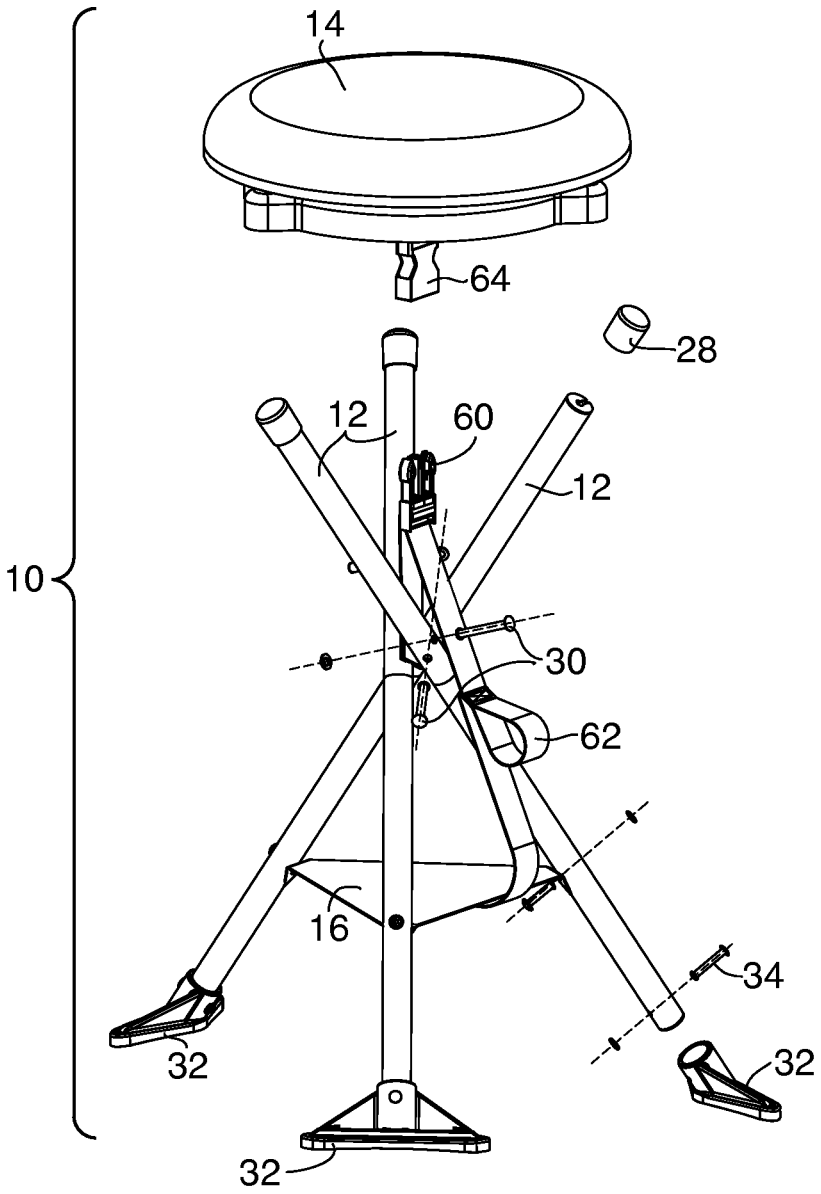
FIG. 3 is a partially exploded perspective view of the stool of FIG. 1.

As shown in FIG. 3, resilient end caps 28 made from rubber, plastic or other suitable material grippingly engage the upper ends of the tubular leg assembly 12. The lower ends of the tubular leg assembly 12 may include feet 32 made from rubber, plastic or other suitable material and held in place by rivets 34. As shown, each foot 32 has a splayed design so as to increase the surface area of the foot 32 contacting the supporting surface on which the stool 10 is set up. Such an increased surface area helps prevent the legs 12 from sinking into soft ground. Alternatively, the feet 32 may be replaced with resilient end caps, such as caps 28 provided on the upper ends of the tubular leg assembly 12. The resilient end caps 28 and or the feet 32 maintain the washers 26 in generally coaxial alignment with the upper and lower end of the tubular parts 18 and 20, as best shown in FIG. 4.

Figure 5:
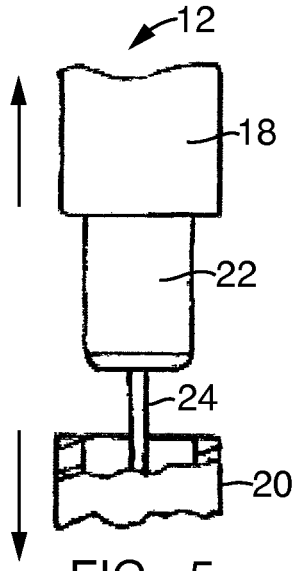
FIG. 5 is a fragmentary side elevational view of a releasable leg-connecting joint used with the stool of FIG. 1 shown in a separated condition.

In FIG. 5, the leg assembly of FIG. 4 is shown with its axially elongated upper and lower parts 18 and 20 disconnected or separated from each other by application of applied force in axially opposite directions, as indicated by the directional arrows in FIG. 5. In accordance with the present invention, the axially elongated upper and lower parts 18 and 20 are separated for collapsing the leg assemblies 12 to a shorter longitudinal dimension, which allows for a reduced size of the stool 10 when it is collapsed for storage and/or transportation.

Figure 2:
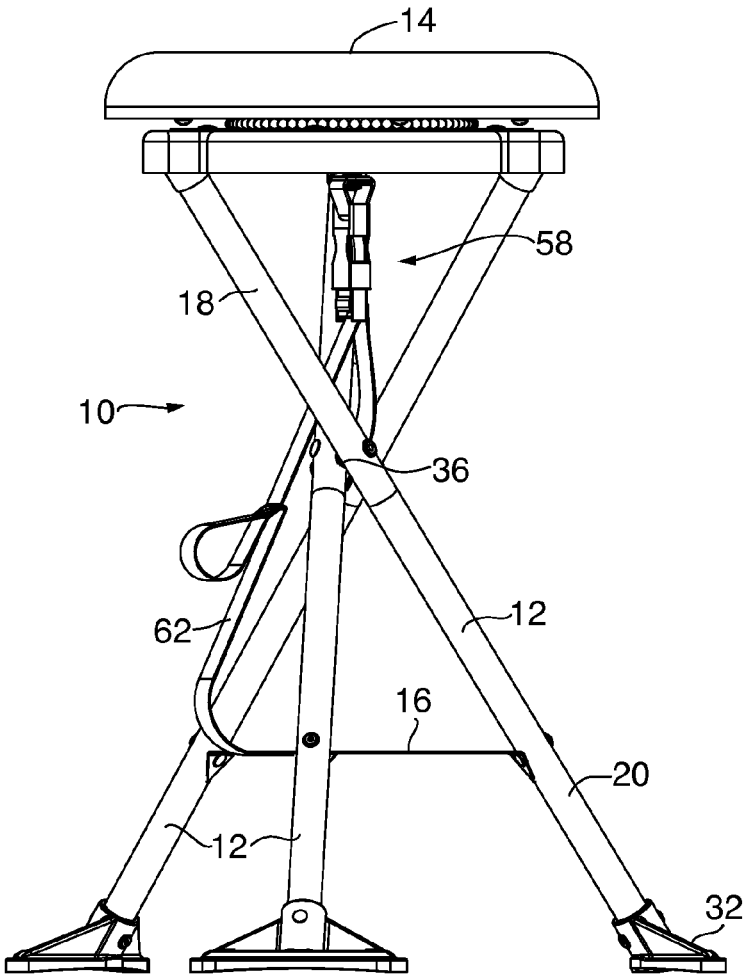
FIG. 2 is a planar front view of the stool of FIG. 1.

As illustrated in FIGS. 1-3, the stool 10 preferably has three legs 12 arranged in upwardly and downwardly splayed relation from a central connection point 36. In accordance with the present invention, the structural components of the stool 10 are reduced to simplify the design of and set-up steps for the stool 10 without compromising the strength and stability of the stool 10. Additional legs may be used in various embodiments of the stool 10 without departing from the spirit and principles of the present invention.

Figure 6:
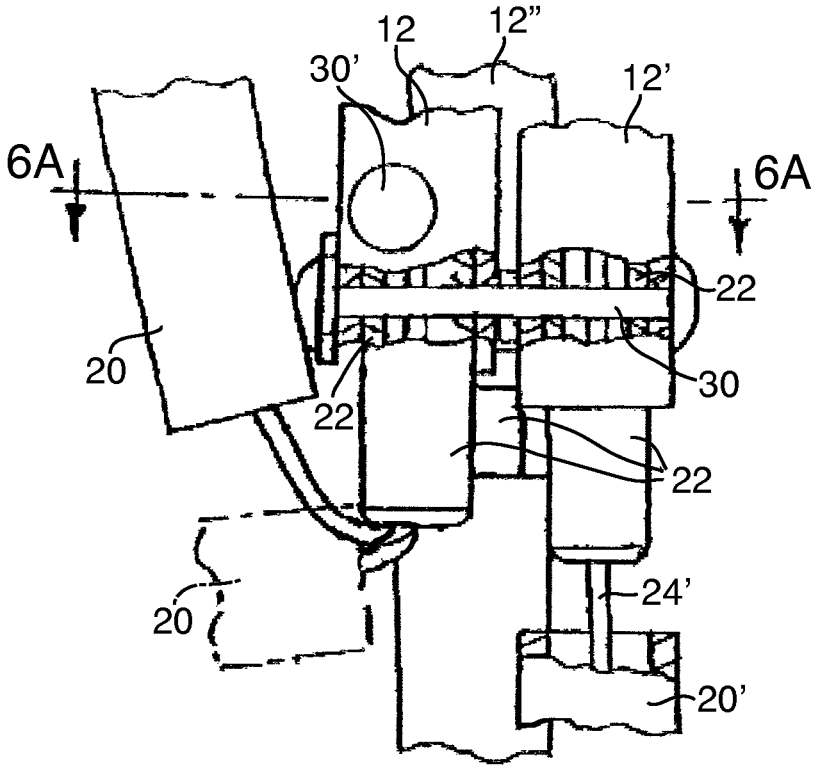
FIG. 6 is a fragmentary side elevational view of the leg pivotal connections for the stool of FIG. 1, showing upper and lower leg parts of the stool in various stages of separation in accordance with the present invention.
Figure 6A:
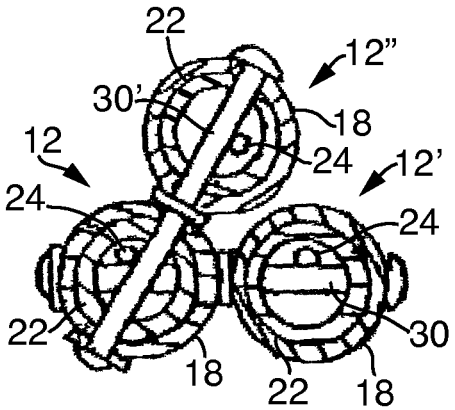
FIG. 6A is a sectional view taken generally along the line A-A of FIG. 6.

Referring to FIG. 3, the three leg assemblies 12 are connected each to another intermediate the upper and lower ends for mutual pivotal movement between the folded and set-up conditions, as will be hereinafter further discussed. The leg assemblies 12 may be connected together in any suitable manner which permits mutual pivotal movement of the legs 12 relative to each other. However, when the present invention is practiced with separable leg assemblies, as hereinbefore described, the upper parts 18 are connected to each other, so that each lower part 20 may be independently separated from its respectively associated upper part 18, for a reason which will be hereinafter further evident. In the illustrated embodiment, two pivot fasteners, indicated at 30 and 30', provide pivotal support for the three legs 12, as best shown in FIGS. 6 and 6A. Specifically, a first headed pivot pin 30 extends transversally through the upper parts 18 of a first leg 12 and a second leg 12' to provide pivotal connection between the first and second legs. A second pivot pin 30' axially upwardly offset from the first pivot pin 30 provides pivotal connection between the first leg 12 and the third leg, which is indicated at 12". Thus, the upper parts of the three legs 12, 12' and 12" are connected for mutual pivotal movement relative to each other. It should now be noted that the pivot pins 30 and 30' also pass through the sleeves 22 associated with the legs supported by the pins. It will now be apparent that the pivot pins 30 and 30' perform dual functions, serving both as pivot pins and as anchors for securing the telescopic joint connecting sleeves 22 within the upper parts of the legs 12, 12' and 12".

Figure 7:
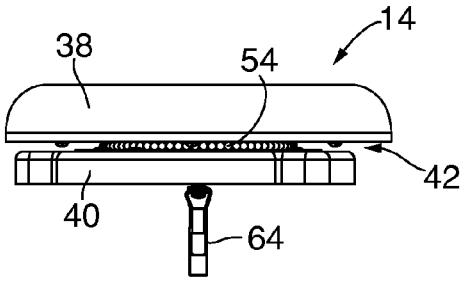
FIG. 7 is a planar side view of a seat member used with the stool of FIG. 1.
Figure 8:
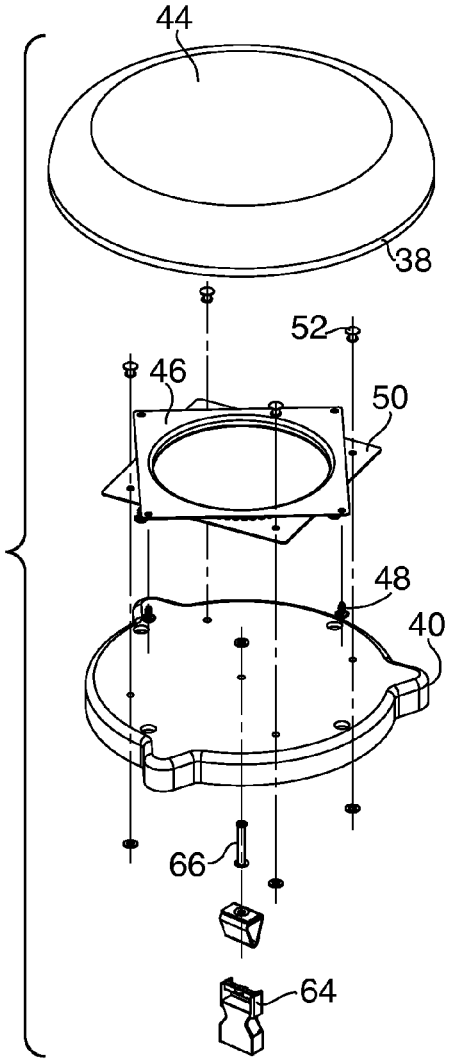
FIG. 8 is an exploded perspective view of the seat member of FIG. 7.
Figure 9:
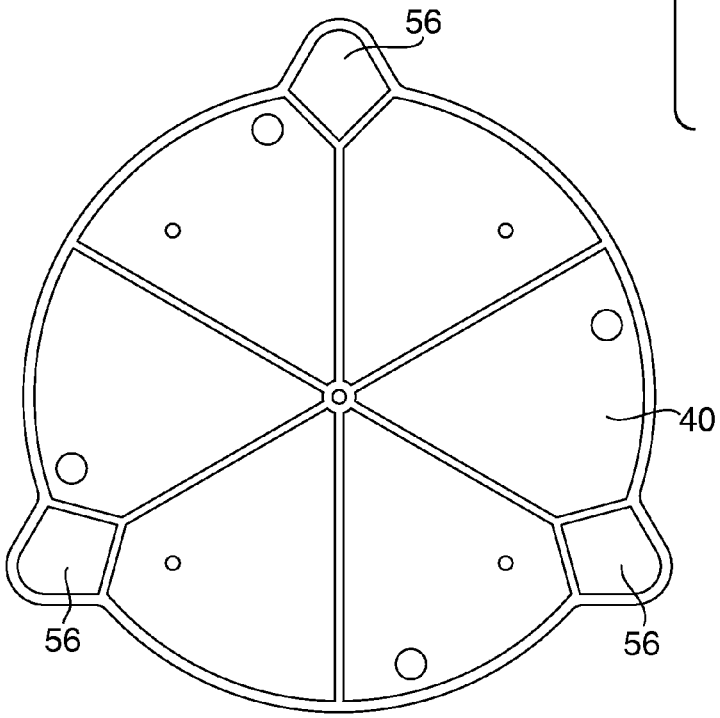
FIG. 9 is a planar bottom view of the seat member of FIG. 7.

The seat member 14 is generally shown in FIGS. 7-9, and preferably comprises a swivel seat. As illustrated in FIG. 8, the seat member 14 comprises an upper portion 38 and a lower portion 40 connected together by a bearing portion 42. The upper portion 38 comprises a flexible, padded swivel-style seat 44 provided 360 degrees of freedom by the bearing portion 42. As shown, the bearing portion 42 comprises a Lazy Susan-style bearing having an upper plate 46 connected to the underside of the upper portion 38 via conventional fastener means—namely, rivets 48—and a lower plate 50 connected to the topside of the lower portion 40 via conventional fasteners means—again, rivets 52—with ball bearings 54 disposed therebetween. The lower portion 40 of the seat member 14 defines a baseplate for connecting the seat member 14 to the leg assemblies 12. In a preferred design, the lower portion is formed from an injection molded plastic and defines recesses 56 for receiving the upper ends of the leg assemblies 12, as shown in FIG. 9. In the set-up condition of the stool 10, the seat member 14 is secured to the leg assemblies 12 by insertion of the upper ends of the legs 12 and, more particularly, the resilient end caps 28 into the recesses 56 formed into the bottom of the lower seat portion 40, as shown in FIG. 1.

The seat member 14 may be further secured to the leg assemblies 12 during the set-up condition of the stool 10 by a buckle fastener 58, as shown in FIG. 2. Specifically, one end of the complementary buckle fastener (e.g., the male buckle piece 60) is attached to the leg assemblies 12 on a flexible adjustable strap 62 attached to the central pivot point 36 of the legs 12 by a pivot pin 30. The other end of the complementary buckle fastener (e.g., the female buckle piece 64) is attached to the underside of the seat member lower portion 40, preferably via a rivet 66 that permits the female buckle piece 64 to pivot about a central axis so the user can align the complementary buckle pieces for connection with each other.

Figure 10:
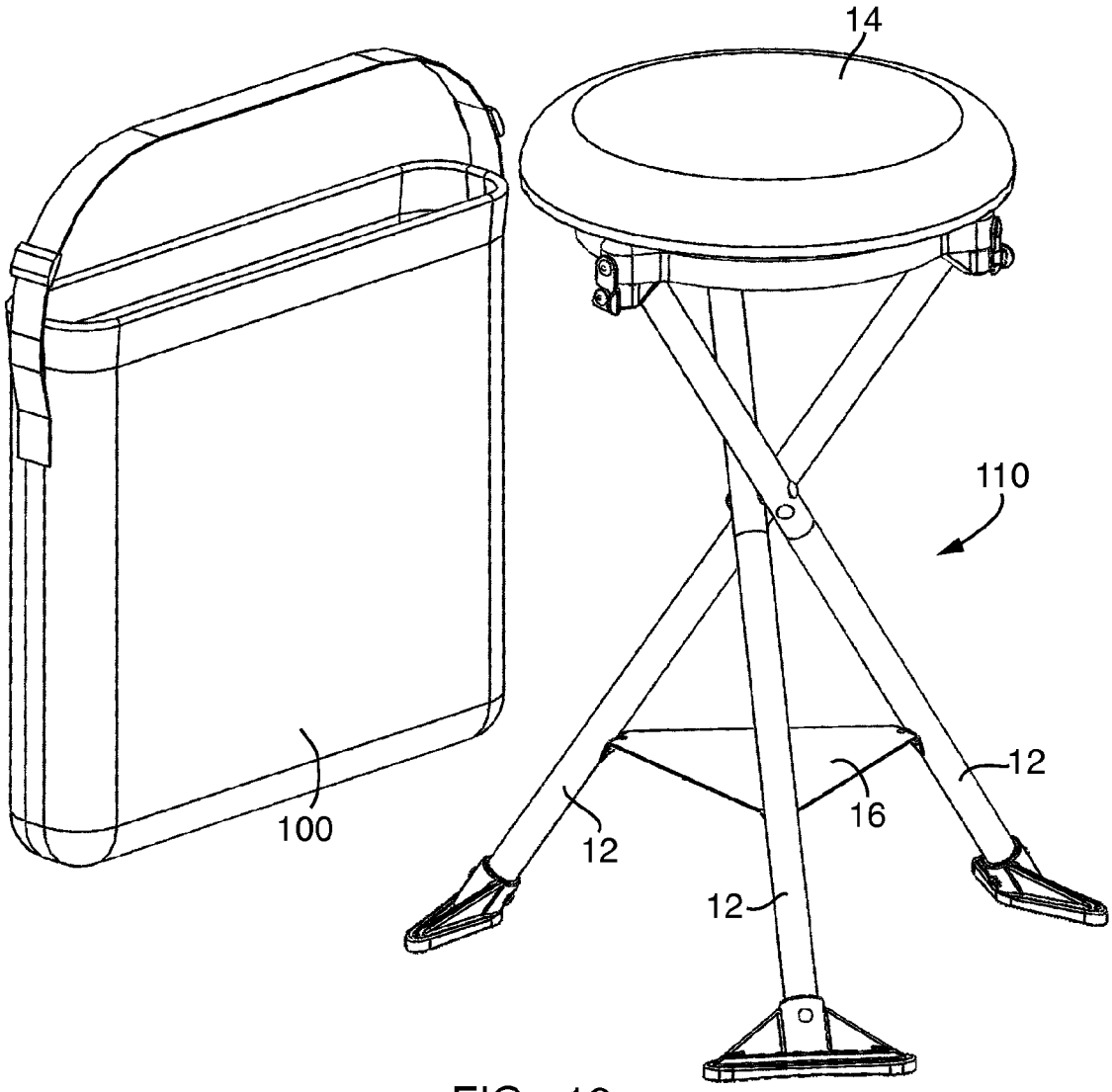
FIG. 10 is a perspective view of a portable collapsible stool in accordance with a second embodiment of the present invention shown in a setup condition.
Figure 11:
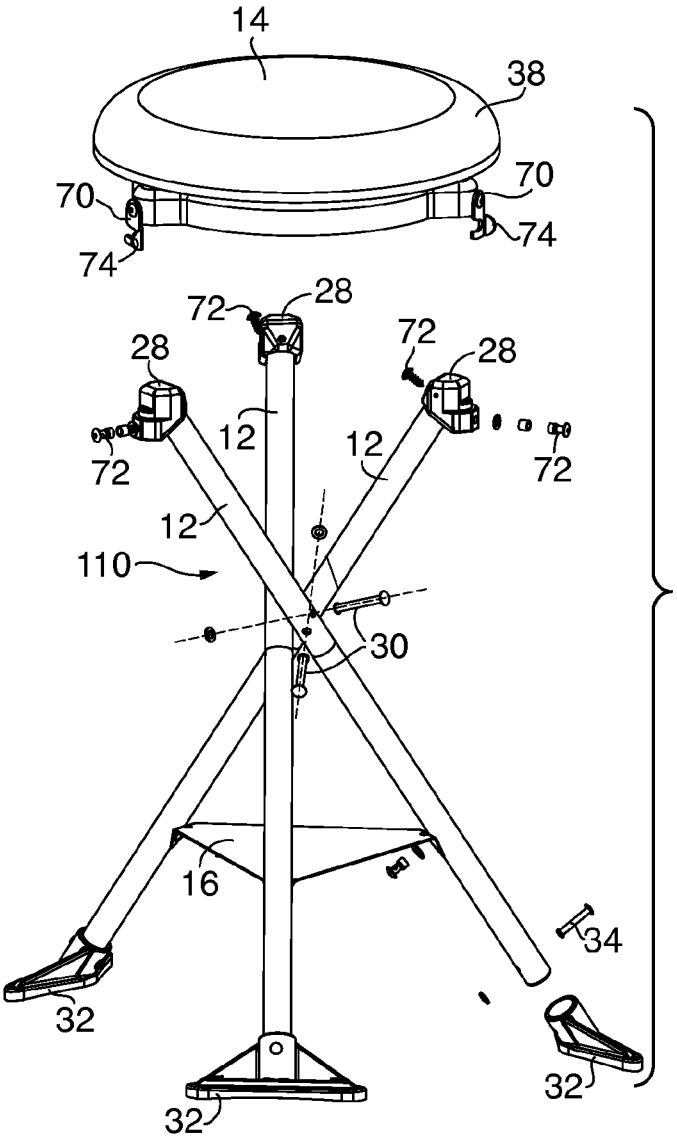
FIG. 11 is a partially exploded perspective view of the stool of FIG. 10.
Figure 12:
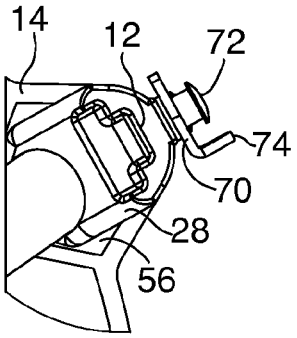
FIG. 12 is a partial planar bottom view of the stool of FIG. 10.

An alternate design of a collapsible stool or seat, generally designated by reference numeral 110, in accordance with the present invention is illustrated in FIGS. 10-12. The stool 110 utilizes the same general structural set-up as for stool 10 as shown and described herein, except that the seat member 14 is secured to the leg assembly 12 in a different manner. Specifically, the lower portion 40 of the seat member 14 includes latches 70 pivotably connected to the seat member 14 and positioned proximate the connection point where the upper ends of the legs assemblies 12 connect with the seat member 14. As shown, the lower portion 40 includes recesses 56 that receive the upper ends of the leg assemblies 12. The upper ends of the leg assemblies 12 further include an outwardly extending projection 72 (such as rivets as shown in FIG. 11). To secure the seat member 14 to the leg assemblies 12, the latches 70 can be pivoted to engage a respective projection 72, as illustrated in FIG. 12. In this regard, the latches also help maintain the seat member 14 in attachment with the leg assemblies 12 when the upper portion 38 is pivoted relative to the lower portion 40. As shown, each latch 70 includes a thumb flange 74 for aiding positioning the latch 70 around a respective projection 72, or likewise for disengaging the latch 70 from the projection 72 for breaking down the stool 110.

Though embodiments of a collapsible stool or seat in accordance with the present invention are illustrated herein as using recesses 56 that receive the upper ends of the leg assemblies 12 of the stool, the present invention can be used with other means for securing a seat member to a plurality of connected leg assemblies. For example, the latches 70 and projections 72 as illustrated in FIGS. 10-12 can be used with a design where a seat member 14 is adapted to lay on top of the upper end of a plurality of leg assemblies 12. The buckle fastener 58, as illustrated in FIG. 2, can also be used with such a design, or with the design illustrated in FIGS. 10-12, or separate, as a means of securing the seat member 14 to the leg assemblies 12.

Further, and in accordance with the present invention, the panel assembly 16, which may include a plurality of connected panels, is attached to and extends between the leg lower parts 20. The illustrated panel assembly 16 may be of the type shown and described in U.S. Pat. No. 6,871,905, which is incorporated herein by reference. It should be noted that the flexible panel assembly has a distinct geometric shape both before and after attachment to the legs 12 and generally provides anti-splay reinforcement to the stool 10 so as to maintain the leg assemblies 12 in desired arrangement and relationship when the stool 10 is in its set-up condition, and more particularly, when a user is sitting on the stool 10 and the user's weight is applied downwardly on the leg assemblies 12. In this regard, the panel assembly 16 may be constructed and arranged to provide substantial lateral reinforcement of the legs 12, thereby substantially increasing the load carrying capability of the stool 10. Specifically, when the stool 10 is in use, the panel assembly 16 is in tension and laterally reinforces the legs 12 by resisting lateral movement of the leg lower ends outwardly and away from each other, thereby substantially increasing the load carrying capacity of the stool 10. The panel assembly 16 may also serve as an auxiliary base of support for the stool 10 when it is supported on soft or sandy ground, which may be penetrated by the feet 32 and the lower ends of the legs 12.

When the stool 10 is in its set-up condition, as shown in FIG. 2, the lower ends of the legs 12 are disposed within a common supporting plane that is generally parallel to the seat member 14. The points of connection between the panel assembly 16 and the legs 12 generally define another plane that is also parallel and in close proximity to, but upwardly spaced from, the supporting plane defined by the lower ends of the legs 12. Thus, when the stool 10 is resting on a firm supporting surface the panel assembly 16 will be generally parallel and in near relation to the supporting surface. If the stool 10 is set up on soft or sandy ground penetrated by the feet 32 or the lower ends of the legs 12, the bottom surface of panel assembly 16 will engage the ground to increase the area of ground support, thereby stabilizing the stool 10 and maintaining the seating surface in a plane substantially parallel to the ground so that the stool 10 may be used where ground conditions are substantially less than ideal.

To collapse the stool 10 to its folded and portable condition, the seat member 14 is first removed by disengaging the buckle fastener pieces 60 and 64 and then removing the seat member 14 from the upper ends of the leg assemblies 12. The legs 12 are then pivoted relative to each other so that each leg is disposed in generally parallel side-by-side relation to the other legs 12. After the legs 12 have been moved into generally parallel relation to each other, the stool 10 is further collapsed by separating each leg lower part 20 from its respectively associated leg upper part 18. The panel assembly 16 now performs a further function serving as a handle for simultaneously separating the leg lower parts 20 from the leg upper parts 18. This operation is performed by holding the upper parts 20 while grasping the panel assembly 16 or the buckle strap 62 and exerting a pulling force on the panel assembly 16 in a generally axial direction and away from the upper parts 18 to effect separation of the lower parts 20 from the connecting sleeves 22.

In FIG. 6, the leg lower parts 20 are shown in various positions of separation from the leg upper parts 18 for the purpose of illustration. However, it should be understood that leg part separation actually occurs substantially simultaneously. Thereafter, the separated leg lower parts 20 are moved upwardly to positions adjacent and generally parallel to the leg upper parts 18 to complete collapse of the stool 10 to its collapsed and portable condition. The collapsed stool 10 may then be inserted into a carrying bag for storage and transportation, such as the bag 100 shown in FIG. 1.

When the stool 10 is removed from its carrying bag 100 and the leg lower parts 20 are released. These parts will automatically and simultaneously snap into connected engagement with associated upper parts 18 being urged to connected position by the elastomeric cords 24 which are in tension when the stool 10 is in its fully collapsed and portable condition. The legs 12 are then pivoted apart to the set-up condition, as shown in FIG. 1, to prepare the stool 10 for use. Once the legs 12 are fully set up, the seat member 14 is mounted onto the upper portions of the legs 12 and secured in place by the buckle fastener 58.

The foregoing description of embodiments of the present invention has been presented for the purpose of illustration and description. It is not intended to be exhaustive or to limit the invention to the form disclosed. Obvious modifications and variations are possible in light of the above disclosure. The embodiments described were chosen to best illustrate the principles of the invention and practical applications thereof to enable one of ordinary skill in the art to utilize the invention in various embodiments and with various modifications as suited to the particular use contemplated.

I claim:

1. A portable collapsible stool comprising:

at least three axially elongated legs having upper and lower portions including upper and lower ends, said legs connected each to another intermediate said ends for mutual pivotal movement between collapsed and set-up conditions, said legs in said collapsed condition being disposed in generally parallel side-by-side relation to each other and said legs in said set-up condition crossing each other with said lower ends in a common supporting plane; and a seat member that incorporates recesses for detachably mounting said seat member on said upper ends of said legs in said set-up condition and that, when so mounted, locks said legs in said set-up condition and defines a seating surface maintained substantially parallel to said supporting plane, at least a portion of said seating surface being pivotable about an axis substantially orthogonal to said supporting plane when said seat member is so mounted, wherein detachment of said seat member from said legs permits movement of said legs to said collapsed condition.

2. The portable collapsible stool as set forth in claim 1, wherein the seat member comprises:

an upper portion including a padded seating surface;

a lower portion defining the recesses for receiving the upper ends of each of the legs; and a bearing portion connecting the upper portion with the lower portion for relative pivotal movement with respect to each other.

3. The portable collapsible stool as set forth in claim 2 wherein the upper portion has 360 degrees of freedom relative to the lower portion.

4. The portable collapsible stool as set forth in claim 2 further comprising at least one fastener connected between the seat member and the legs for securing the seat member to the legs in the set-up condition.

5. The portable collapsible stool as set forth in claim 4 wherein the at least one fastener comprises at least one latch pivotably connected to the lower portion of the seat member proximate at least one recess and a corresponding projection outwardly extending from the upper end of at least one leg, wherein the latch engages the projection to secure the seat member to the legs in the set-up condition.

6. The portable collapsible stool as set forth in claim 5, wherein the upper end of each of the legs includes an outwardly extending projection, and the lower portion of the seat member includes a latch for engagement with each such projection.

7. The portable collapsible stool as set forth in claim 4 wherein the fastener comprises complementary connectors, one of said connectors being attached to the lower portion of the seat member and the other of said connectors being attached to the legs.

8. The portable collapsible stool as set forth in claim 7 wherein the complementary connector attached to the legs is attached to a central connection point of the legs in the set-up condition via a flexible adjustable strap.

9. The portable collapsible stool as set forth in claim 1 wherein said legs comprise tubular legs wherein the lower portion of each leg is telescopically connected to a corresponding upper portion when the stool is in its set-up condition.

10. The portable collapsible stool as set forth in claim 1, further comprising a flexible panel assembly attached to and extending between said lower portions of said legs for laterally reinforcing said legs to increase the carrying capacity of said stool and being disposed in another plane parallel to said supporting plane.

11. The portable collapsible stool as set forth in claim 10 wherein said legs comprise tubular legs having separable upper and lower parts joined by telescopic connections and contain elastomeric cords normally biasing said parts into connected engagement and said panel assembly is connected to each of said lower parts and functions as a handle for substantially simultaneously separating said lower parts from said upper parts.

12. The portable collapsible stool as set forth in claim 11 wherein said telescopic connections include sleeves carried by said upper parts and received within said lower parts and said legs are connected each to another by pivot pins carried by said upper parts and anchoring said sleeves to said upper parts for separation of said sleeves from said lower parts.

13. A portable collapsible stool comprising:

at least three axially elongated legs having upper and lower portions including upper and lower ends, said legs connected each to another intermediate said ends for mutual pivotal movement between collapsed and set-up conditions, said legs in said collapsed condition being disposed in generally parallel side-by-side relation to each other and said legs in said set-up condition crossing each other with said lower ends in a common supporting plane; and a seat member that incorporates recesses for detachably mounting said seat member on said upper ends of said legs in said set-up condition, said seat member when so mounted locking said legs in said set-up condition and defining a seating surface maintained substantially parallel to said supporting plane at least a portion of said seat member being pivotable relative to the legs without affecting the set-up condition of the stool, said seat member comprising an upper portion including a padded seating surface, a lower portion that incorporates the recesses positionable on the upper ends of each of the legs, and a bearing portion connecting the upper portion of the seat member with the lower portion for relative pivotal movement with respect to each other.

14. The portable collapsible stool as set forth in claim 13, further comprising at least one latch pivotably connected to the lower portion of the seat member and a corresponding projection outwardly extending from the upper end of at least one leg, wherein the latch engages the projection to secure the seat member to the legs in the set-up condition.

15. The portable collapsible stool as set forth in claim 14, wherein the upper end of each of the legs includes an outwardly extending projection, and the lower portion of the seat member includes a latch for engagement with each such projection.

16. The portable collapsible stool as set forth in claim 14 wherein the at least one latch is positioned proximate a respective recess.

17. A portable collapsible stool comprising:

at least three axially elongated legs having upper and lower portions including upper and lower ends, said legs connected each to another intermediate said ends for mutual pivotal movement between collapsed and set-up conditions, said legs in said collapsed condition being disposed in generally parallel side-by-side relation to each other and said legs in said set-up condition crossing each other with said lower ends in a common supporting plane;

a seat member that incorporates recesses for detachably mounting said seat member on said upper ends of said legs and when so mounted locking said legs in said set-up condition and defining a seating surface maintained substantially parallel to said supporting plane, at least a portion of said seat member being pivotable relative to the legs without affecting the set-up condition of the stool; and a flexible panel assembly attached to and extending between said lower portions of said legs for laterally reinforcing said legs to increase the carrying capacity of said stool and being disposed in another plane parallel to said supporting plane.

18. The portable collapsible stool as set forth in claim 17, wherein the seat member comprises:

an upper portion including a padded seating surface;

a lower portion that incorporates the recesses positionable on the upper ends of each of the legs; and a bearing portion connecting the upper portion with the lower portion for relative pivotal movement with respect to each other.

19. The portable collapsible stool as set forth in claim 18, wherein the upper end of each of the legs includes an outwardly extending projection, and the lower portion of the seat member includes latches pivotably connected to said lower portion for engagement with each such projection to secure the seat member to the legs in the set-up condition.

20. The portable collapsible stool as set forth in claim 19 wherein the lower portion of the seat member defines recesses for receiving the upper ends of each of the legs, wherein the latches are each positioned proximate a respective recess.

* * * * *